United States Patent [19]

Sauter et al.

[11] Patent Number: 5,016,297

[45] Date of Patent: May 21, 1991

[54] SINK ASSEMBLY

[75] Inventors: Bruce M. Sauter, Schaumberg, Ill.; Jeffrey F. Tempas, Oostburg; Robert B. Sandman, Sheboygan, both of Wis.

[73] Assignee: Kohler Co., Kohler, Wis.

[21] Appl. No.: 502,463

[22] Filed: Mar. 30, 1990

[51] Int. Cl.[5] ..... A47K 1/04; E03C 1/33

[52] U.S. Cl. ..... 4/619; 4/635

[58] Field of Search ..... 4/619, 635, 636, 638, 4/632, 633, 634; 267/263, 179, 179.1; 156/305

[56] References Cited

U.S. PATENT DOCUMENTS

| | | | |
|---|---|---|---|
| D. 234,464 | 3/1975 | Stairs, Jr. | D23/290 |
| 3,029,446 | 4/1962 | Just | 4/633 |
| 3,056,971 | 10/1962 | Hornik | 4/633 |
| 3,308,225 | 3/1967 | Wells | 264/263 |
| 3,613,128 | 10/1971 | Moyer | 4/633 |
| 4,374,695 | 2/1983 | Ikeda et al. | 4/619 |
| 4,844,944 | 7/1989 | Graefe et al. | 4/619 |

OTHER PUBLICATIONS

Kohler Co. Brochure, p. 108, Item K-6500-C.
Kohler Co. Brochure, Item B.
Kohler Co. Brochure, p. 10, Item Rivinia Kitchen Sink (K-3227).
Kohler Co. Brochure, pp. 10-12b, Item K-3285-H.
Jacob Delafon Brochure, p. 100, Item 1257, Cristal Enduro.
Benthor Sanijura Brochure, Item double bottom mounted sinks.
La Culinaire Brochure, Item The Chatelaine Model.

*Primary Examiner*—Ernest G. Cusick
*Assistant Examiner*—David J. Walczak
*Attorney, Agent, or Firm*—Quarles & Brady

[57] ABSTRACT

A sink assembly is disclosed that has a separate rim and basin made of different materials. The basin has a flange surrounding a bowl that is exposed under the rim to form an accessible ledge. A glass-filled polyester resin is injected into a mold adjacent the underside of the rim member and the flange. The polyester resin bonds with the rim member and prevents the basin from moving relative to the rim member.

6 Claims, 5 Drawing Sheets

FIG. 1
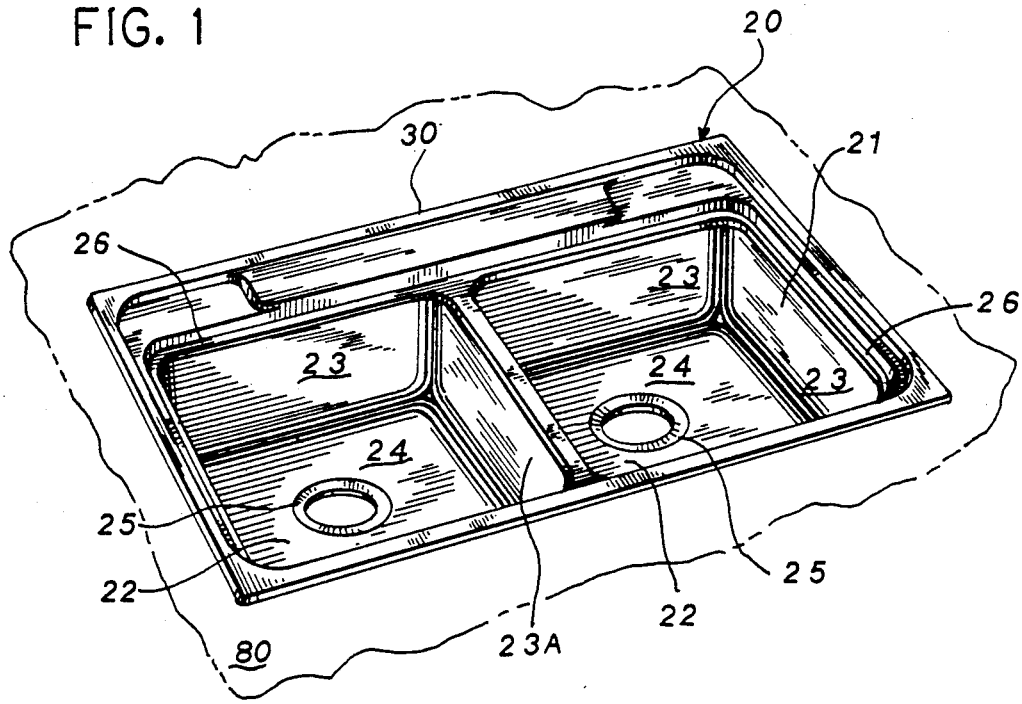
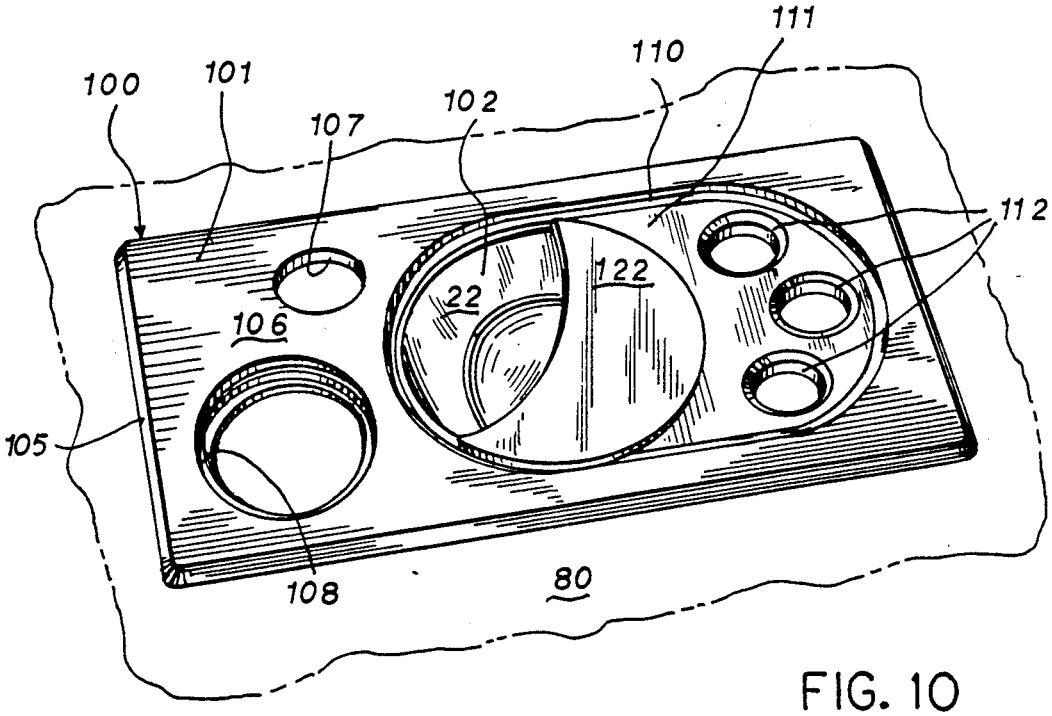
FIG. 10

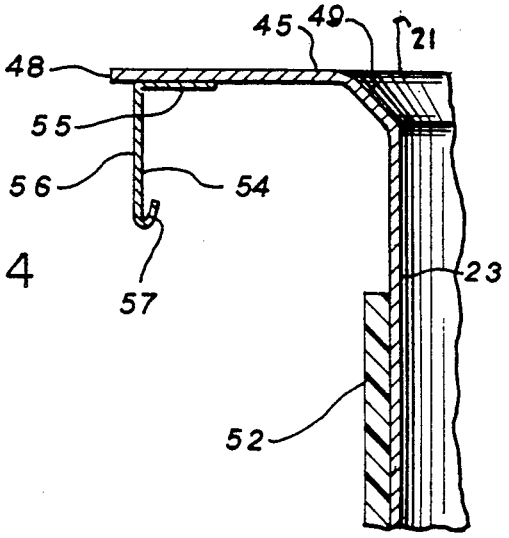
FIG. 4
FIG. 5
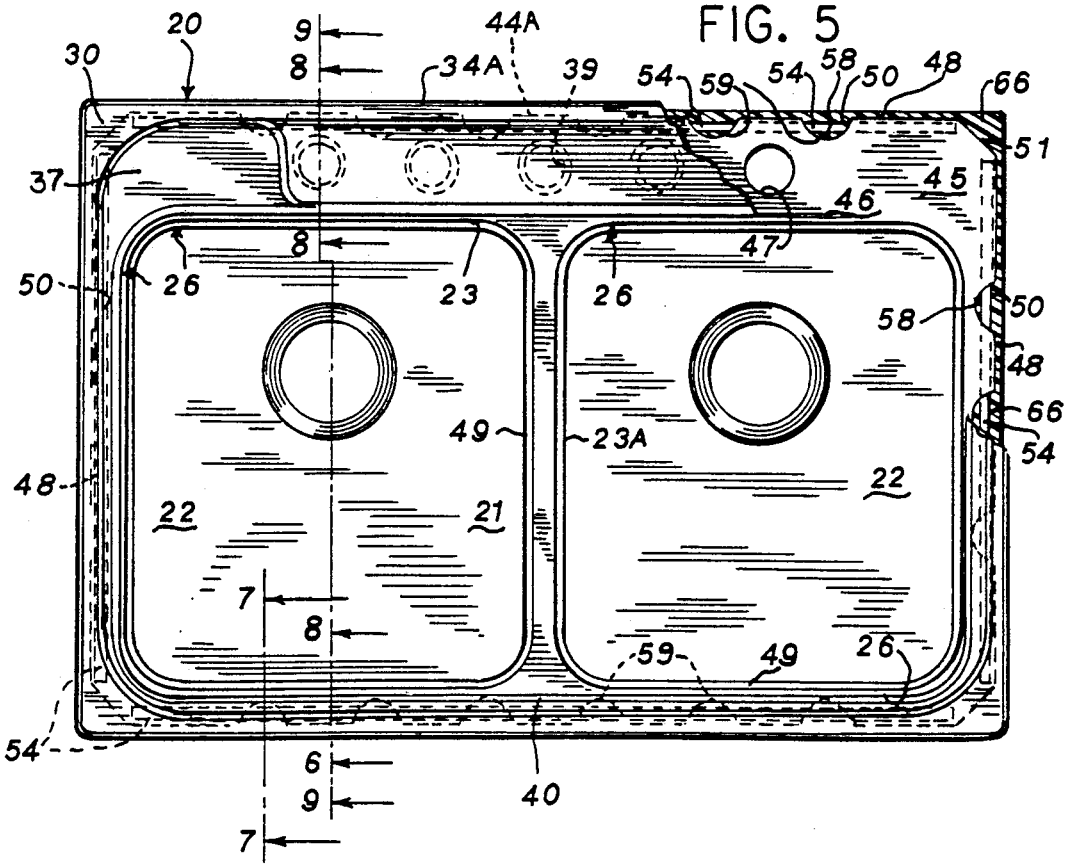

SINK ASSEMBLY

FIELD OF THE INVENTION

This invention relates to a sink assembly. More particularly, it pertains to sinks where the top rim is made of one material and the bowl is made of another.

BACKGROUND OF THE INVENTION

Sinks have for years been formed as single pieces (e.g., of stainless steel). Unfortunately, such sinks limit the materials that can be used (as all parts of the sink must be equally resistant to water and the like).

Two-piece sink assemblies consisting of a rim member and a bowl member were therefore constructed. Some manufacturers dropped the sink in from the top with an overhanging bowl flange being exposed on top of the rim. This worked, but had some drawbacks from an aesthetic standpoint. Others used under mounting systems. However, these systems usually involved the use of clamp/adhesive systems that were expensive and/or labor intensive. Also, many of these sink assemblies left the joint between the bowl and rim difficult to clean.

It can therefore be seen that a need exists for an improved apparatus for securing a sink member of one material to a rim member of another.

SUMMARY OF THE INVENTION

The present invention is designed to provide a sink assembly having a basin secured to a support rim, where the basin and support rim are formed of different materials. In general, the sink assembly has a support rim with an opening therethrough and a basin with a lower bowl and an upper flange. The flange is positioned under a lower side of the support rim so that the bowl is visible from the top of the support rim through the opening. The assembly includes a coupler that is bonded to the support rim. The coupler has a first portion attached to the lower side of the support rim and a second portion positioned under a part of the basin. The second portion is located so as to restrict movement of the basin relative to the support rim. The coupler is formed in a molding process that uses the support rim as part of the mold. This aspect of the invention secures the basin to the support rim and results in a water-tight seal between the components. The bond between the coupler and the support rim is sufficiently sturdy to retain the basin for its intended purpose. Advantageously, the attachment is achieved without using bolts, screws or clamps and without requiring the basin or the support rim to have special fastener holes.

In another aspect, the coupler is formed in a molding operation that also uses the flange as part of the mold. This aspect assures that the basin remains positioned under the lower side of the support rim. The position of the second portion of the coupler blocks movement of the basin.

In a preferred form, the coupler is a polyester resin, the support rim is an acrylic, and the bowl is made of metal. This aspect provides a sink assembly having a metal bowl sturdily secured to an acrylic support rim. The assembly beneficially allows the support rim and the bowl to have different colors. Also, the attachment does not use an expensive and/or labor intensive clamping system.

In another aspect of the invention, the periphery of the basin includes alternating straight edges and recesses, and the sink assembly includes a J-channel connected under the rim. The J-channel has an upper attachment surface and a hook downwardly spaced apart from the attachment surface. The coupler covers the attachment surface but not the hook. The hook portion of the J-channels can be used to attach the sink assembly to a countertop.

The invention further provides a sink assembly including a rim member having a sink opening and a sink member having a bowl and a main flange surrounding the upper portion of the bowl. The flange is positioned under the lower side of the rim member so that a portion of the flange is positioned inward of the sink opening to form a ledge. The ledge surrounds the bowl and is visible from the top of the rim member through the opening. The sink assembly also includes a means located under the rim for restricting relative movement between the bowl and the rim. This aspect provides a ledge which allows the joint area between the rim and sink members to be easily cleaned. The ledge is also useful for mounting dish racks, cutting boards or other items.

Thus, it is an object of the invention to provide an apparatus for securing a metal sink member to a plastic rim member where the connection is sturdy yet relatively easy to produce.

It is another object of the invention to provide an apparatus for securing a metal sink member to a plastic rim member without incorporating bolts or screws, and without requiring the formation of special attachment holes.

It is another object of the invention to provide an apparatus for securing a sink member to a rim member in a manner that does not create an inaccessible joint, but rather allows the joint area between the members to be easily cleaned.

It is a further object of the invention to provide a two-piece sink assembly that has a secure water-tight seam.

The foregoing and other objects and advantages of the present invention will appear from the following description. In the description, reference will be made to the accompanying drawings which illustrate preferred embodiments of the present invention. These embodiments do not represent the full scope of the invention. Reference should therefore be made to the claims herein for interpreting the full scope of the invention.

BRIEF DESCRIPTION OF THE DRAWINGS

FIG. 1 is a perspective view of a sink assembly according to the present invention, the dotted lines indicating that the sink assembly is mounted in a countertop;

FIG. 4 is a view taken along line 4—4 of FIG. 3;

FIG. 5 is a top plan view of the sink assembly shown in FIG. 1, although shown not mounted in a countertop, with portions broken away and portions shown in section for purposes of illustration;

FIG. 10 is a perspective view of a bar sink assembly representing an alternate embodiment of the invention, the dotted lines indicating that the bar sink assembly is mounted in a countertop;

DETAILED DESCRIPTION OF THE PREFERRED EMBODIMENTS

Figure 2:
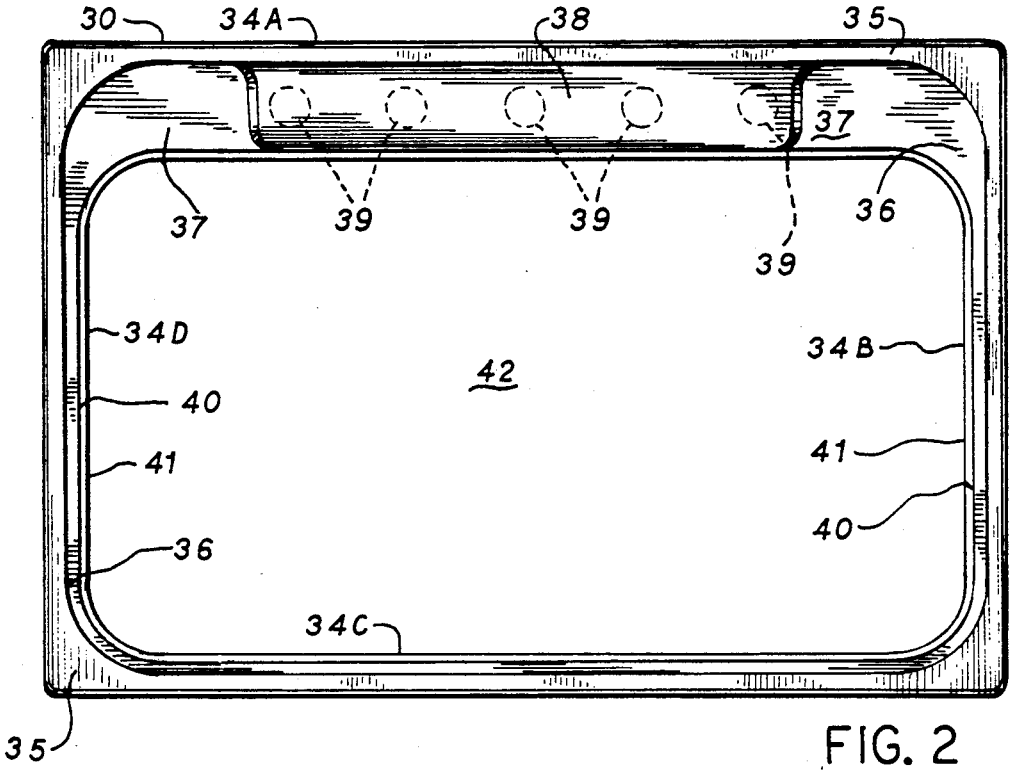
FIG. 2 is a top plan view of a rim member which forms part of the sink assembly shown in FIG. 1.

Referring to FIG. 1, a sink assembly 20 is shown mounted in a countertop 80. The sink assembly 20 includes a sink member or basin 21 formed preferably of stainless steel. The basin 21 has a pair of bowls 22 formed with walls 23, including a shared wall 23A. Each bowl 22 incorporates a floor 24 which slopes downward to a drain 25. The sink member 21 is advantageously mounted on the underside of a rim member or support rim 30 according to the present invention. The mounting exposes a ledge 26 of the sink member 21 that extends fully around the sink member inside of the rim member 30. Although not shown in the drawings, the sink assembly 20 may also include a faucet, a spray, a soap/lotion dispenser or other items.

The rim member or support rim 30 is shown separately in FIG. 2 and is preferably formed of a plastic material such as silica-filled acrylic which provides desirable aesthetic characteristics. The rim member 30 is generally rectangular with sides 34A, 34B, 34C and 34D. A raised surface 35 extends around the periphery of the rim member 30 to retain water. A lower surface 36 lies inward of the raised surface 35 and includes a widened section 37 along the rear 34A. The widened section 37 has an elevated fitting mounting platform 38. The underside of the elevated mounting platform 38 is formed with relatively thin knock-out areas 39.

The rim member 30 includes a sloped wall 40 that is formed inward of the lower surface 36 and that terminates in a bottom edge 41. A sink opening 42 is defined by the bottom edge 41. The sink opening 42 is open to and permits access to the bowls 22 when the components are assembled as described below and shown in FIG. 1. The rim member 30 is formed to assure that the bottom edge 41 is flat.

Figure 3:
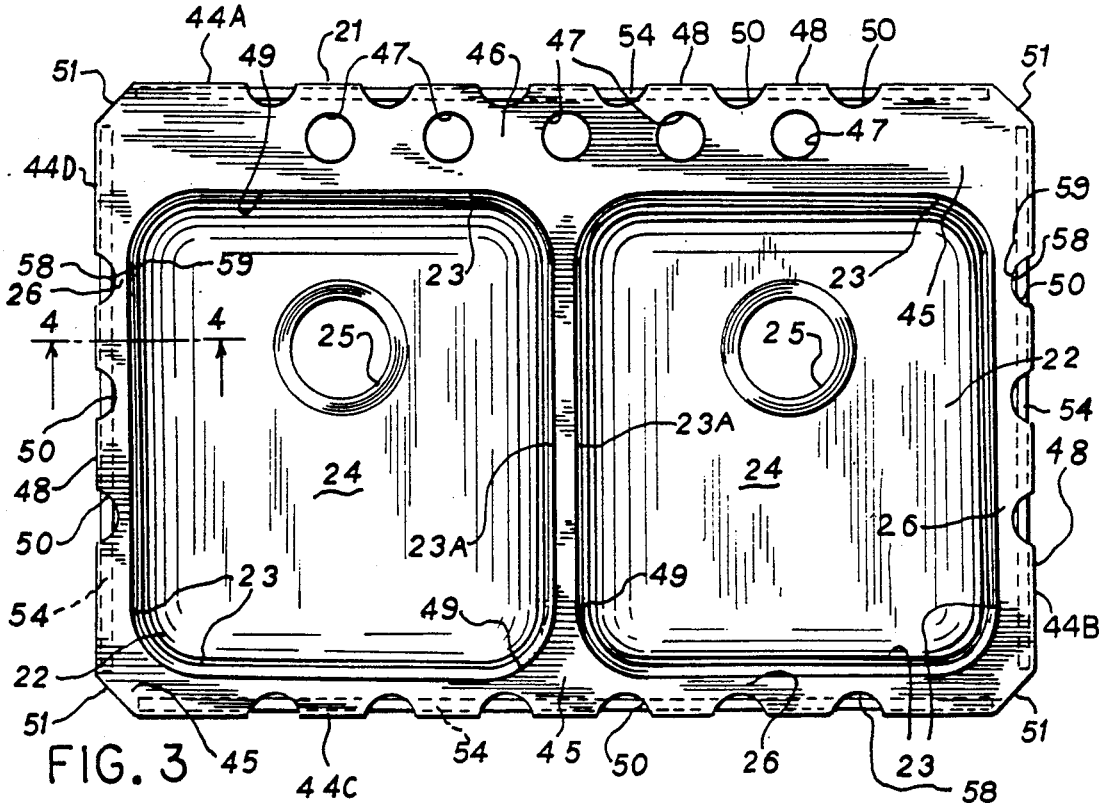
FIG. 3 is a top plan view of a bowl structure used with the sink assembly of FIG. 1.

Viewing FIG. 3, the sink member (basin structure) 21 has four sides 44A, 44B, 44C and 44D and a main flange 45 surrounding the bowls 22. The walls 23 and 23A of the bowls 22 extend downward from the main flange 45 to the basin floors 24. The underside of each bowl 22 may be coated with a sound-dampening material 52 (FIGS. 6–9), as well known and employed in the art. A tapered edge 49 (best seen in FIGS. 6–9) provides a transition between the main surface (top flange) 45 and the substantially vertical bowl walls 23 and 23A. Along the side 44A, the main flange 45 has a widened section 46 with holes 47. The position of the widened section 46 and the holes 47 is comparable to the pesition of the widened section 37 and knock-out areas 39 of the rim member 30.

Figure 7:
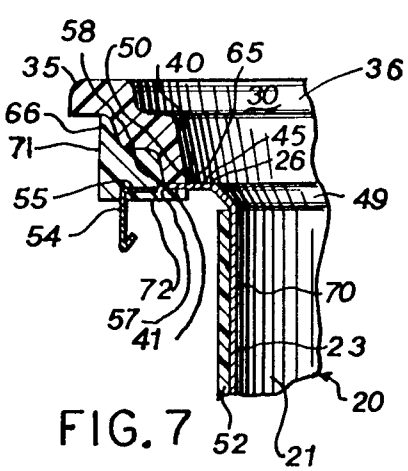
FIG. 7 is a view taken along line 7—7 of FIG. 5.

Each side 44A, 44B, 44C and 44D of the sink member 21 has an alternating pattern of straight edges 48 and recesses 50. The recesses 50 extend inward toward the bowls 22 to a point labeled reference numeral 59 (FIGS. 3, 5 and 7). The inward extent 59 of the recesses 50 is spaced apart from the tapered edges 49 to provide for the ledge 26 along sides 44B, 44C and 44D, as further described below. Along side 44A, the recesses 50 are spaced apart from the tapered edges 49 due to the widened section 46. The sink member 21 is formed with four blunt corners 51.

Four stainless steel J-channels 54 (FIGS. 3–9) are preferably welded to the underside of the sink member 21. The J-channels 54 include an attachment surface 55, a spacer 56 and a hook 57 (FIG. 4). The flat attachment surface 55 is welded to the sink member 21 so that the spacer 56 is transverse to the plane of the main flange 45. The hook 57 is thus spaced apart from the main flange 45 of the basin 21. One J-channel 54 is welded parallel to each side 44A, 44B, 44C and 44D, adjacent but just inward of the straight edges 48. Note that a gap 58 is formed between the J-channels 54 and the inner most portion 59 of the recesses 50 (see FIGS. 3 and 7). The J-channels are appropriately sized to extend along the sides 44A, 44B, 44C and 44D without projecting into the corners 51 of the sink member 21.

The basin (sink member) 21 and the rim member 30 are secured together as illustrated in FIGS. 5–8. The basin 21 is first positioned with the main flange 45 in direct contact with the bottom edge 41 of the rim member 30. The bowls 22 are open to and centered within the sink opening 42 so that part of the main flange 45, i.e., the ledge 26, is exposed all the way around the inside of the sloped wall 40. The ledge 26 and the sloped wall 40 intersect one another forming an obtuse angle at a joint area designated by reference numeral 65 in FIGS. 6–8. Outward of the sloped wall 40, the main flange 45 and the rim member 30 are spaced apart from one another because the raised surface 35, lower surface 36 and the elevated portion 38 lie above (viewing FIGS. 6–8) the bottom edge 41 of the rim member 30. The overall size of the basin 21 (measured in the plane of the main flange 45) is smaller than that of the rim member 30, so that the perimeter of the main flange 45 lies inward of the perimeter of the rim member.

While securing the basin 21 to the support rim 30, these components are preferably inverted (relative to their position in FIGS. 6–8) for easier access. The support rim 30 is positioned against a surface which will not scratch its finish while it is inverted. Also, because the basin 21 is somewhat pliable, a clamp or press (not shown) is needed to assure that the main flange 45 remains in contact with the bottom edge 41 during the assembly procedure.

The basin 21 and the rim member 30 are joined using a glass-filled polyester resin 66. This coupler (polyester resin) 66 is used because it bonds with the silica-filled acrylic rim member 30 and provides sufficient strength to maintain the basin 21 against the rim member. Also, the polyester resin 66 will not deteriorate or melt any of the materials used during assembly.

A mold (not shown) made of silicon rubber is positioned against the basin 21 and the rim member 30 to shape the polyester resin 66 while it hardens. The polyester resin 66 (when in a liquid state) is pumped into a fill hole and air is bled from a vent hole, so that the polyester resin completely fills the mold. The mold remains in place for a time after injection to allow the polyester resin to harden.

Figure 8:
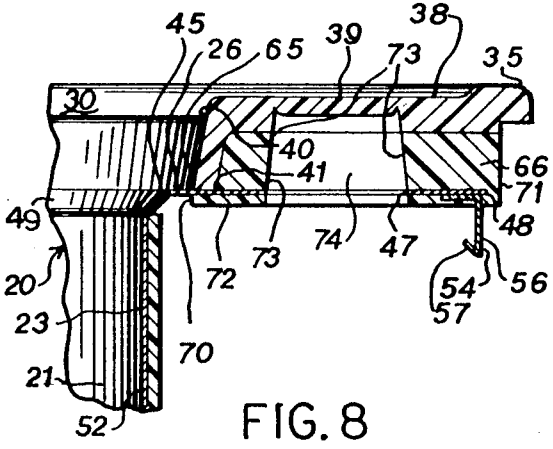
FIG. 8 is a view taken along line 8—8 of FIG. 5.

The polyester resin 66 is shaped by the mold as shown in FIGS. 5–8. The polyester resin 66 has an interior wall 70 extending downward from the underside of the main flange 45 of the rim member 30. The interior wall 70 is formed generally in line with the position where the sloped wall 40 contacts the main flange 45 of the basin 21. A generally vertical exterior wall 71 of the polyester resin 66 is formed beneath the raised surface 35 of the rim member 30. The mold forms the polyester resin 66 to the level of a bottom surface 72, which is spaced from the main flange 45 of the basin 21 a sufficient distance to completely cover the attachment surface 55 of the J-channel 54. The mold also prevents the resin 66 from becoming too thick and interfering with access to the hooks 57. Surrounding each hole 47 in the sink member 21, the polyester resin 66 is formed with partially-angled walls 73 (FIG. 8). The walls 73 provide an aperture 74 to insert faucet hardware. Except for the apertures 74, the polyester resin 66 fills the space outward of the sloped wall 40 and between the main flange 45 and the rim member 30.

Figure 6:
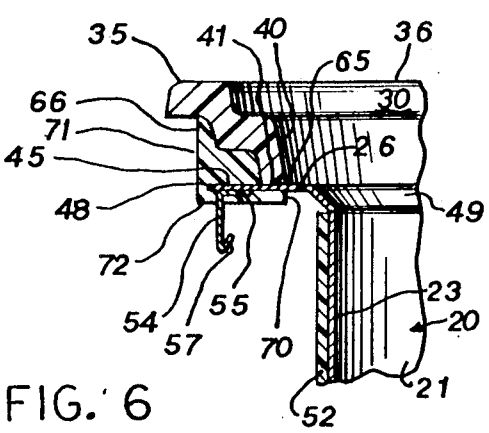
FIG. 6 is a view taken along line 6—6 of FIG. 5.

The polyester resin (coupler) 66 bonds to the rim member 30 and thereby secures the basin 21 to the rim member. As shown by FIGS. 6 and 8, the location of the polyester resin 66 prevents the main flange 45 from moving away from the rim member 30. The portion of the polyester resin 66 adjacent the rim member 30 bonds with the rim member 30 to prevent movement of the resin 66 relative to the rim member. The portion (exterior wall 71) of the polyester resin 66 along the edges 48 and recesses 50 blocks lateral movement of the basin 21, and the portion (bottom surface 72) beneath the main flange 45 blocks movement of the basin away from the bottom edge 41. Additionally, as shown in FIG. 7, the recesses 50 allow the polyester resin 66 to fill the gaps 58 between the attachment surface 55 and the innermost portions 59 of the recesses, which further aids in securing the basin 21 to the rim member 30. The alternating arrangement of straight edges 48 and recesses 50 allows a sufficient quantity of the resin 66 to bond with the rim member 30, while also locating a sufficient quantity of resin 66 beneath the basin 21 to hold it in place.

Figure 9:
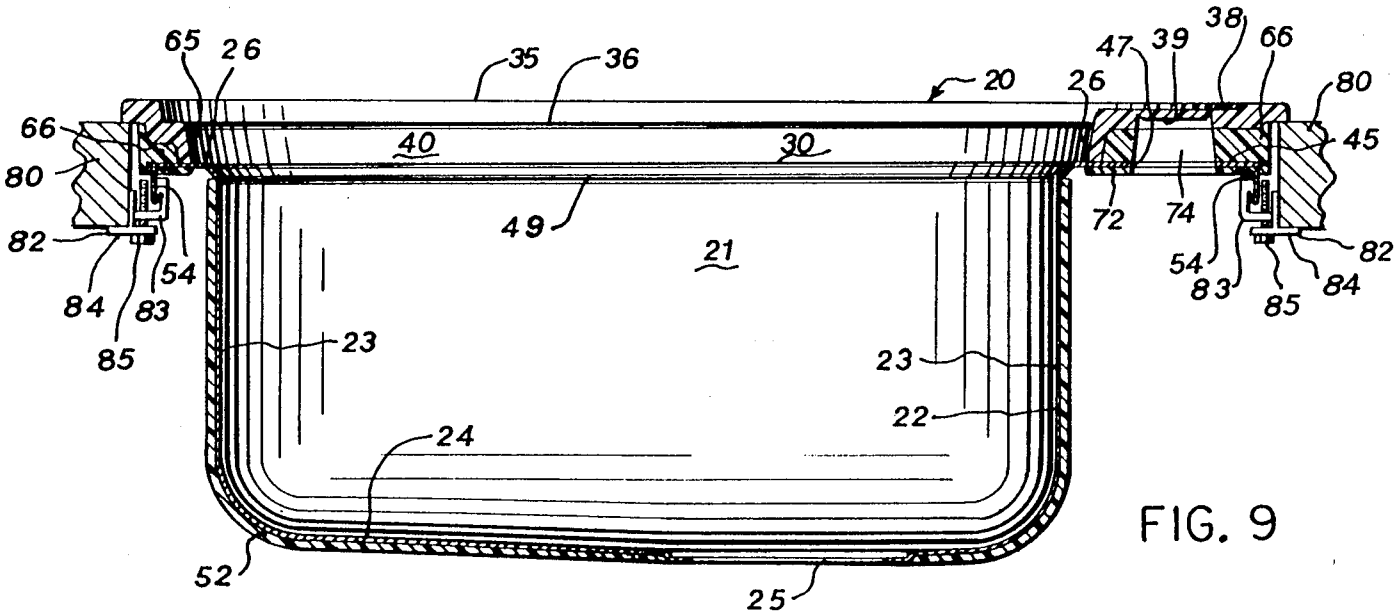
FIG. 9 is a view taken generally along line 9—9 of FIG. 5, but showing the sink assembly mounted in the countertop.

The sink assembly 20 may then be installed in a countertop 80 as shown in FIG. 9. The sink assembly 20 is lowered into an appropriate size hole in the countertop. The knock-out areas 39 in the rim member 30 may be removed to accommodate plumbing hardware or accessories as desired. The hardware should project through the holes 47, the apertures 74 and any removed knock-out areas 39. A silicone sealant (not shown) may be employed between the countertop 80 and the bottom of the raised surface 35 to prevent leakage. A plurality of clamps 82 are spaced along the J-channels 54 to retain the sink assembly 20 against the countertop 80. The clamps 82 have a barbed portion 83 that attaches to the hook 57 of the J-channel 54. A T-portion 84 of the clamp 82 moves relative to the barbed portion 83 due to rotation of a bolt 85. One side of the T-portion 84 engages the bottom surface of the countertop 80.

Thus, the sink assembly 20 as described allows the stainless steel sink member 21 to be readily and securely fastened to the silica-filled acrylic rim member 30. The attachment also provides a convenient ledge 26 for positioning sink accessories, such as cutting boards or dish racks. The disclosed sink assembly 20 further incorporates a water-tight sanitary joint area 65 between the sink member 21 and the rim member 30, which may be easily accessed and cleaned.

Figure 11:
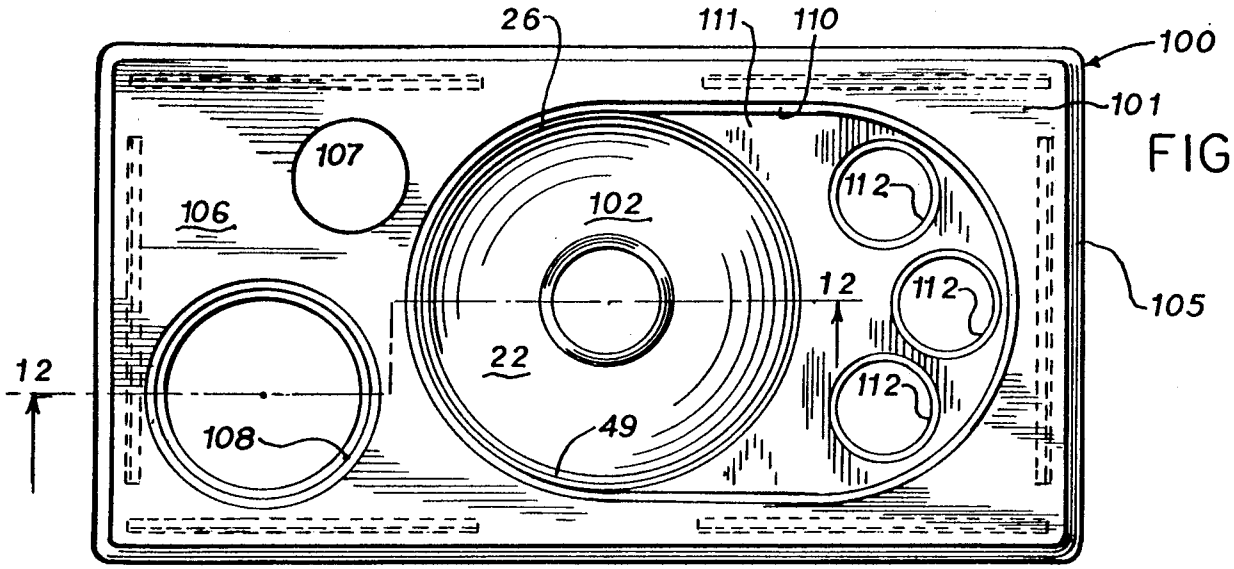
FIG. 11 is a top plan view of several components of the bar sink assembly shown in FIG. 10.
Figure 12:
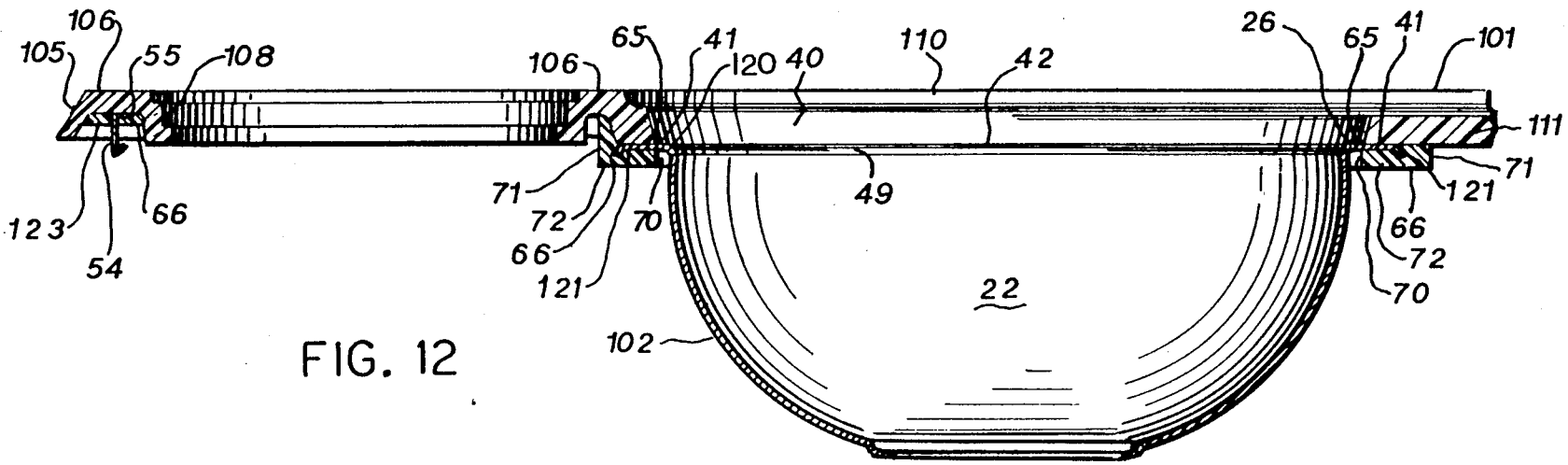
FIG. 12 is a view taken along line 12—12 of FIG. 11.

An alternate embodiment of the invention is illustrated in FIGS. 10–12, where components similar to those previously described have the same reference numerals. A bar sink assembly 100 consists of a support rim or rim member 101 and a basin or sink member 102. The rim member 101 has an angled edge 105 on the perimeter of a raised surface 106. One hole 107 is formed in the rim member 101 to allow a faucet (not shown) to be connected to the bar sink assembly 100. A stepped aperture 108 of the rim member 101 can be used to house for example, a removable ice bucket with a cover (not shown). An oval-shaped curved wall 110 defines the boundaries of a lower surface 111. Several stepped openings 112 in the lower surface 111 may house removable cups (not shown). The rim member 101 includes a sloped wall 40 that terminates in a bottom edge 41, and the bottom edge defines an inner sink opening 42 (FIG. 12).

The sink member 102 has a tapered edge 49 surrounding the bowl 22. A main flange 120 surrounds the tapered edge 49 and includes an outwardly and downwardly directed flap 121. The sink member 102 is secured to the rim member 101 using the polyester resin (coupler) 66 in a manner similar to that previously described. The bowl 22 is centered relative to the sink opening 42 and the sink member 102 is held in physical contact with the rim member 101. A mold is used to shape the polyester resin 66 with an interior wall 70, an exterior wall 71 and a bottom surface 72.

The sink member 102 is captured by the polyester resin 66. The resin 66 located along the exterior wall 71 prevents the main flange 120 and the bowl 22 from moving laterally relative to the rim member 101. The resin 66 along the bottom surface 72 prevents the main flange 120 from moving away from the rim member 101. Note that the exterior wall 71 has a different height on opposite sides of the sink member 102, due to the contour of the underside of the rim member 101. The polyester resin 66 provides a sufficiently strong bond, however, so that the a bowl could be attached to a rim member having a substantially flat underside. Likewise, the flap 121 is not required to obtain a strong attachment of the sink member 102 to the rim member 101.

With the sink member 102 secured to the rim member 101 in this manner, a ledge 26 of the main flange 120 is exposed. The ledge 26 results because the opening in the main flange 120 for the bowl 22 is smaller than the diameter of the sink opening 42. The ledge 26 allows for easy cleaning of the joint area 65 between the sink member 102 and the rim member 101. Also, the ledge 26 can be used to position objects, such as the cutting board 122 shown in FIG. 10.

In this embodiment, the J-channels 54 are not welded to the sink member 102 but are instead secured directly to the rim member 101. The underside of the rim member 101 is formed with inverted canals 123 (FIG. 12). The J-channels 54 are positioned in the canals 123 and the attachment surface 55 of the J-channels is covered with polyester resin 66. A mold is used to ensure that the polyester resin 66 completely covers the attachment surface 55 but does not become too thick so that it interferes with the clamps 82 (FIG. 9) attaching to the hooks 57. The polyester resin 66 bonds with the rim member 101 and secures the J-channels 54 in place.

The polyester resin 66 in this embodiment provides an efficient and inexpensive way to attach the stainless steel sink member 102 to the non-metal rim member 101. Use of the polyester resin 66 as disclosed also permits the stainless steel J-channels 54 to be secured to the non-metal rim member 101, and provides a sturdy construction that can be clamped to a countertop.

The foregoing detailed description has been for the purpose of illustration. Thus, a number of modifications and changes may be made without departing from the spirit and scope of the present invention. For example, the sink members 21 and 102 need not be in direct physical contact with the rim members 30 and 101. Rather, a spacer could be employed between the sink member and the rim member, or polyester resin could fill a space between the components. Likewise, the particular shape of the periphery of the sink members 21 and 102 (i.e., straight edge 48, recesses 50 or flap 121) may be altered and still provide a sturdy bond. Therefore, the invention should not be limited by the specific embodiments described, but only by the claims.

We claim:

1. A sink assembly, comprising:

a support rim having an opening therethrough;

a basin having a lower bowl and an upper flange, the flange being positioned under a lower side of the support rim so that the bowl is visible from the top of the support rim through the opening;

a coupler bonded to the support rim, the coupler having a first portion attached to the lower side of the support rim and a second portion positioned under a part of the basin, the second portion being located so as to restrict the basin's movement relative to the support rim, the coupler having been formed in a molding operation that used the support rim as part of the mold; and a J-channel connected to the coupler, the J-channel having an upper attachment surface and a hook downwardly spaced from the attachment surface, the coupler being formed to cover the attachment surface but not the hook.

2. The sink assembly of claim 1, wherein the coupler was formed in a molding operation that also used the flange as part of the mold.

3. The sink assembly of claim 1, wherein the coupler is made from a polyester resin and the support rim is an acrylic.

4. The sink assembly of claim 1, wherein the periphery of the basin includes alternating straight edges and recesses.

5. The sink assembly of claim 1, wherein a portion of the upper flange is positioned inward of the opening to form a ledge that surrounds the bowl and is visible from the top of the support rim through the opening.

6. The sink assembly of claim 1, wherein the bowl is made of metal.

* * * * *